US010429078B2

(12) United States Patent
De' Longhi et al.

(10) Patent No.: US 10,429,078 B2
(45) Date of Patent: Oct. 1, 2019

(54) DOOR FOR APPARATUS TO COOK AND/OR HEAT FOOD AND CORRESPONDING PRODUCTION METHOD

(71) Applicant: DE' LONGHI APPLIANCES SRL CON UNICO SOCIO, Treviso (IT)

(72) Inventors: Giuseppe De' Longhi, Treviso (IT); Fabio Bisetto, Roncade (IT)

(73) Assignee: DE' LONGHI APPLIANCES S.R.L. CON UNICO SOCIO, Treviso (IT)

( * ) Notice: Subject to any disclaimer, the term of this patent is extended or adjusted under 35 U.S.C. 154(b) by 0 days.

(21) Appl. No.: 15/325,401

(22) PCT Filed: Jul. 9, 2015

(86) PCT No.: PCT/IB2015/055205

§ 371 (c)(1),
(2) Date: Jan. 10, 2017

(87) PCT Pub. No.: WO2016/005939

PCT Pub. Date: Jan. 14, 2016

(65) Prior Publication Data

US 2017/0198921 A1 Jul. 13, 2017

(30) Foreign Application Priority Data

Jul. 10, 2014 (IT) ..... UD2014A0119

(51) Int. Cl.
*F23M 7/00* (2006.01)
*F24C 15/04* (2006.01)

(52) U.S. Cl.
CPC ..... *F24C 15/04* (2013.01)

(58) Field of Classification Search
CPC ..... F24C 15/04
USPC ..... 126/200, 190
See application file for complete search history.

(56) References Cited

U.S. PATENT DOCUMENTS 5,819,722 A * 10/1998 Katz ..... F24C 15/006 126/200
2003/0140596 A1* 7/2003 Bienick ..... B29C 43/18 52/784.1
2005/0034486 A1* 2/2005 Bienick ..... D06F 39/14 68/3 R
2014/0110391 A1* 4/2014 Estrella ..... F24C 15/325 219/400

(Continued)

FOREIGN PATENT DOCUMENTS

DE 10 2004 002470 A1 8/2005
DE 10 2004 011036 A1 9/2005

(Continued)

OTHER PUBLICATIONS

Search Report and Written Opinion for PCT/IB2015/055205, dated Nov. 13, 2015.

*Primary Examiner* — Vivek K Shirsat
(74) *Attorney, Agent, or Firm* — Marshall, Gerstein & Borun LLP

(57) ABSTRACT

Door for apparatus to cook and/or heat food, that comprises at least a perimeter frame and two panels, located distanced and facing each other and delimited externally by said at least one perimeter frame, so as to form a closed chamber, at least one of the two panels being co-molded with the at least one perimeter frame.

14 Claims, 2 Drawing Sheets

(56) References Cited

U.S. PATENT DOCUMENTS

2015/0101587 A1* 4/2015 Hynes ..... A47F 3/0434
126/200

FOREIGN PATENT DOCUMENTS

EP 1 043 140 A2 10/2000
EP 2 159 489 A2 3/2010

* cited by examiner

DOOR FOR APPARATUS TO COOK AND/OR HEAT FOOD AND CORRESPONDING PRODUCTION METHOD

FIELD OF THE INVENTION

The present invention concerns a door with double glazing that can be applied for example, but not only, in apparatuses to cook and/or heat food, such as for example electric cookers, ovens or other similar apparatuses, both for domestic and non-domestic use.

The present invention also concerns a method to produce said door, and also the cooking and/or heating apparatus on which the door is assembled.

BACKGROUND OF THE INVENTION

Apparatuses for cooking and/or heating food are known, such as for example electric cookers or ovens, provided with a door, generally located on a front wall, to introduce or remove the food from an internal cooking zone.

These apparatuses normally include one or more electric resistances, activated when the apparatus is switched on, and generally disposed near one or more internal parts of a cooking and/or heating zone.

In recent years such apparatuses have been regulated by different safety laws, so as to define the maximum temperatures admissible in correspondence with the external surfaces, to prevent any burning due to contact therewith.

It is known that in correspondence with a door of the apparatuses, a great heat dispersion occurs, which can prevent the limits established by the law from being respected, since the heat propagated from inside to outside creates an increase in temperature of the external surfaces.

For this reason it is known to make the door double-glazed, or alternatively with transparent panels mounted on a frame, to reduce the heat dispersion, also allowing, at the same time, to inspect the food from outside while the apparatus is in use.

Here and hereafter in the description, the term "double-glazing" means a panel made of transparent material, not necessarily made of glass, but also of different and suitable material, such as for example Plexiglas or polymethylmethacrylate or other similar material suitable for the purpose.

The two panels and the frame of the door delimit an air chamber, which separates the cooking zone from the external environment, thus reducing dispersion between inside and outside the apparatus.

One disadvantage of known doors concerns the possible formation of condensation inside the chamber, due to the difference in temperature between the cooking zone and the outside environment.

The condensation can consequently be deposited in correspondence with internal surfaces of the panels of the door, thus limiting, when the apparatus is functioning, the user's view toward the cooking zone and making the apparatus in its entirety unaesthetic.

One possible solution provides to make a door in which the two panels are mounted in correspondence with a holed metal frame, which allows air to circulate, thus reducing the problem of formation of condensation.

Another disadvantage of such solutions is that fats and oils, used during the cooking of the foods, can also be deposited on the panels and can dirty the surfaces thereof.

If not removed, these substances can affect and further worsen the esthetics and visibility of the whole apparatus; they can also promote the generation of molds, fungi or other parasite organisms, causing poor hygiene conditions.

One possible solution to this problem provides to make a door in which the panels can be removed from the frame, allowing access to the chamber, so that it can be cleaned.

Another possible solution provides to make the door by making the double-glazing panels adhere to the frame using an attachment element, such as for example silicone, so as to seal them to it.

One disadvantage of this solution is that it is impossible to guarantee over time a perfect seal and impermeability of the air chamber; this consequently entails phenomena, although limited, of condensation and formation of mold, fungi or other parasite organisms.

Another disadvantage of this known solution is the high cost of making the sealing, and the additional times of the production cycle.

One purpose of the present invention is to produce a door with a double-glazed wall, in the meaning indicated above, which prevents the formation of condensation in correspondence with the internal surfaces of the panels.

Another purpose of the present invention is to produce a door that can reduce or even prevent the deposit of fats or oils in correspondence with the surfaces of the panels.

Another purpose of the present invention is to produce a door for an apparatus that allows to obtain energy saving when cooking foods, compared with known doors.

Another purpose of the present invention is to perfect a method for the production of a double-glazed door that is easy to make, simple to implement and that does not entail increases in the production costs compared with the state of the art.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, the present invention concerns a door for an apparatus to cook and/or heat food, which comprises at least a perimeter frame and two panels, made of an at least partly transparent material such as glass, polycarbonate (PC), Plexiglas or polymethylmethacrylate (PMMA) or other suitable material.

The two panels, during use, are located distanced and facing each other and delimited externally, for at least a part of their perimeter, by the at least one perimeter frame, so as to form a closed chamber between them.

According to the present invention at least one of the two panels is co-molded with the at least one perimeter frame.

The perimeter frame is preferentially made of plastic material or other suitable moldable material.

In accordance with possible forms of embodiment, the door comprises two perimeter frames, each co-molded separately with one of the two panels.

In accordance with possible forms of embodiment, the door comprises a perimeter frame co-molded with both the panels, disposed distanced with respect to each other to form said chamber.

With this door it is therefore possible to reduce, or even eliminate, the possibility of formation of condensation inside the chamber, since the at least one perimeter frame and the panels are disposed to form the chamber so as to guarantee a perfect seal and cohesion.

Moreover, with this door it is also possible to avoid dirtying the internal sides of the panels, at least partly transparent, which form the chamber, allowing an optimal view of the inside of the apparatus through the panels themselves.

The present invention also concerns a method to produce the door, which provides steps to supply the panels and the at least one perimeter frame and to position the panels opposite and distanced from each other to form, together with the at least one perimeter frame, a closed chamber.

In accordance with possible forms of embodiment, at least one of the two panels is obtained by co-molding with the at least one perimeter frame.

The production method of the door has the advantage that it is easily executed, with limited production costs, and can be made in series.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
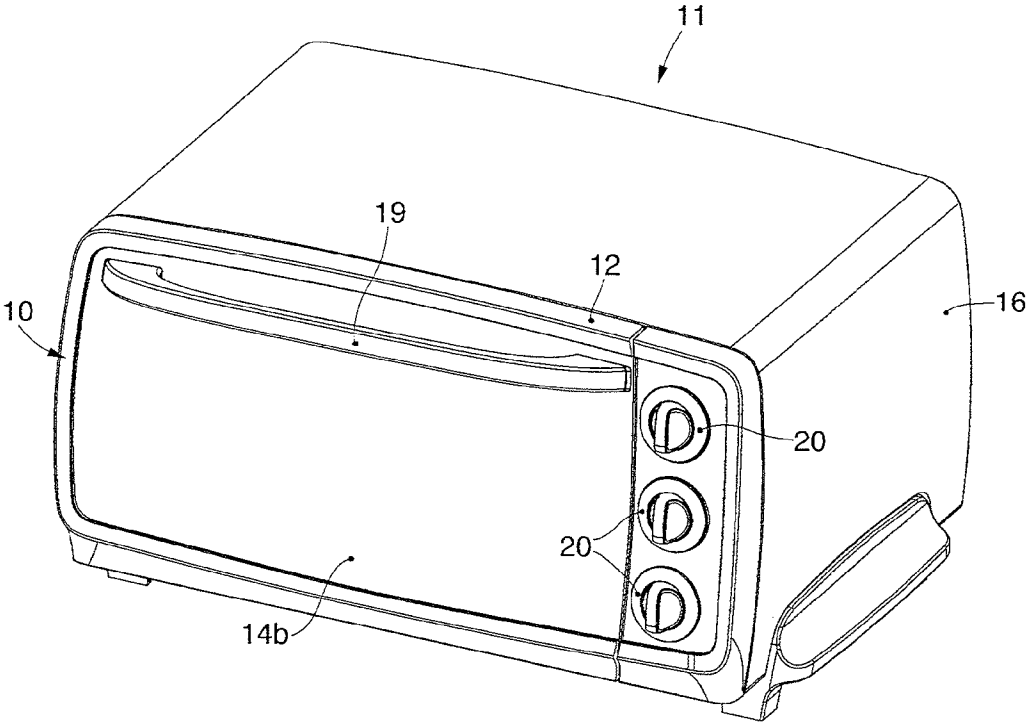
FIG. 1 is a perspective view of an apparatus with a door in accordance with the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF SOME FORMS OF EMBODIMENT

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment. It is understood that the present invention shall include all such modifications and variants.

In accordance with the present description, the invention concerns a door 10 that can be applied in apparatuses 11 to cook and/or heat food, such as for example, but not only, electric cookers, ovens or other similar apparatuses 11, both for domestic and non-domestic use.

FIG. 1 is used to describe a possible application of the door 10 on the apparatus 11, in this case an electric cooker.

In particular, the door 10 can be assembled advantageously on a front surface of the apparatus 11, to facilitate the introduction and removal of food from inside it.

Moreover, to facilitate opening and/or closing the door 10, the door 10 can comprise a gripping handle 19.

The door 10 can also comprise a plurality of adjustment elements 20 of the known type, in the case of FIG. 1 three adjustment elements 20, configured to selectively adjust some parameters of the apparatus 11 during use, such as for example, but not only, the cooking temperature, the type of cooking, the cooking time or other similar parameters.

The apparatus 11 normally comprises one or more heating elements 17, such as for example electric resistances, selectively activated when the apparatus is switched on and normally disposed inside a cooking zone 18, in a position of proximity to one of the internal faces of walls of the apparatus 11.

In forms of embodiment described here, the door 10 comprises at least one perimeter frame 12 and two panels 14*a* and 14*b*, respectively internal and external, located distanced and facing each other, of which at least one of the two panels 14*a* and 14*b* is co-molded with the perimeter frame 12.

The panels 14*a* and 14*b* are preferably made of a transparent material in order to allow to see inside the apparatus 11 with the door 10 closed.

In forms of embodiment described with reference for example to FIG. 2, the door 10 comprises two perimeter frames 12*a* and 12*b*, respectively internal and external, each of which is associated to one of the two panels 14*a*, and 14*b*.

Figure 3:
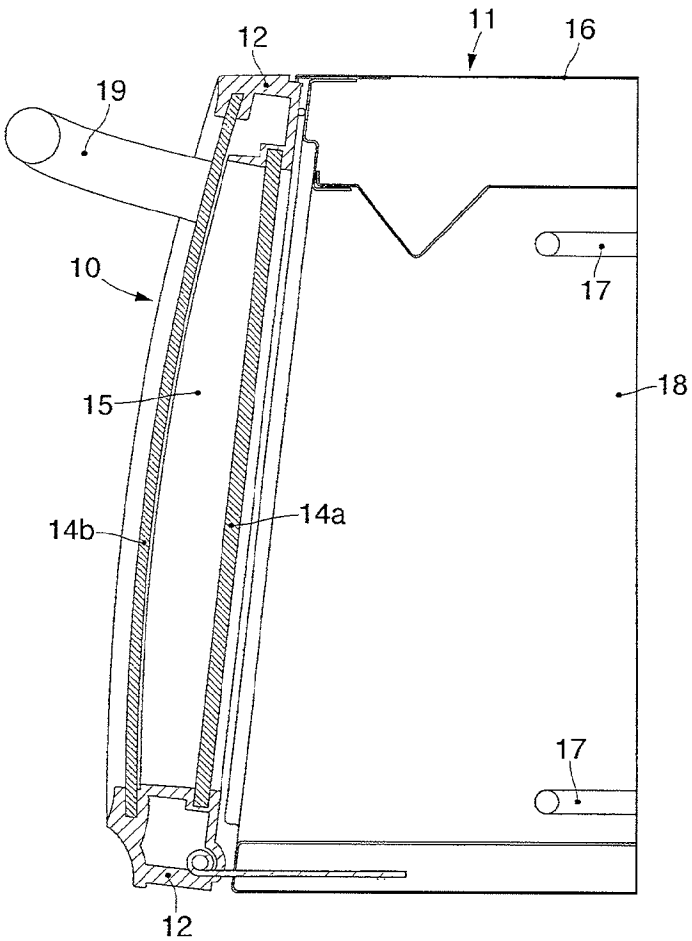
FIG. 3 is a lateral view in section of a variant of FIG. 2.

In other forms of embodiment of the present invention, described for example with reference to FIG. 3, the door 10 comprises a single perimeter frame 12, to which both the panels 14*a* and 14*b* are associated.

The panels 14*a* and 14*b* are delimited externally, in this case completely, by the at least one perimeter frame 12, 12*a*, 12*b* so as to define therewith a closed chamber 15, of which the panels 14*a* and 14*b* form two opposite lateral walls.

In particular, together with a body 16 of the apparatus 11, the chamber 15 defines the internal cooking zone 18, which it is possible to access by means of the door 10.

Each perimeter frame 12, 12*a* and 12*b* can advantageously be made of plastic material able to resist the increase in temperature determined during use by the heating elements 17 located in the internal cooking zone 18 of the apparatus 11 and in proximity to at least one of the internal faces of the cooking zone 18.

The plastic material can be, for example but not only, polybutylene terephthalate (PBT), polypropylene (PP), polyethylene (PE), polyethylene terephthalate (PET), polymethylmethacrylate (PMMA), polystyrene (PS) or other resistant plastic material or again, a combination thereof.

In other forms of embodiment described here, each perimeter frame 12, 12*a*, and 12*b* can be made of metal material, at least in one portion thereof, so as to advantageously reduce production costs.

The two panels 14*a* and 14*b* can be made of glass, such as tempered glass for example, low emissivity glass or other similar types, so as to guarantee sufficient resistance to the heat that develops when the apparatus 11 is in use.

In variant forms of embodiment, the two panels 14*a* and 14*b* can also be made of plastic material that, in its transparency, is similar to glass, such as for example polycarbonate (PC), Plexiglas or polymethylmethacrylate (PMMA) or other type of transparent plastic material.

In forms of embodiment described here, the two panels 14*a* and 14*b* can be made of the same material or, alternatively, each of a different material, for example when it is necessary to differentiate their resistance to heat.

For example, the internal panel 14*a* can be made of a more resistant material, since it is located near the heating elements 17 of the apparatus 11, while the external panel 14*b* can be made of a less resistant material, because it is farther from the heating elements 17.

Depending on the type of materials used, it is therefore possible to contain the costs associated with the production of the door 10.

In forms of embodiment described here, the door 10 is advantageously made by hot co-molding of at least one of the two panels 14*a* and 14*b* with the at least one perimeter frame 12, 12*a* and 12*b*.

Figure 2:
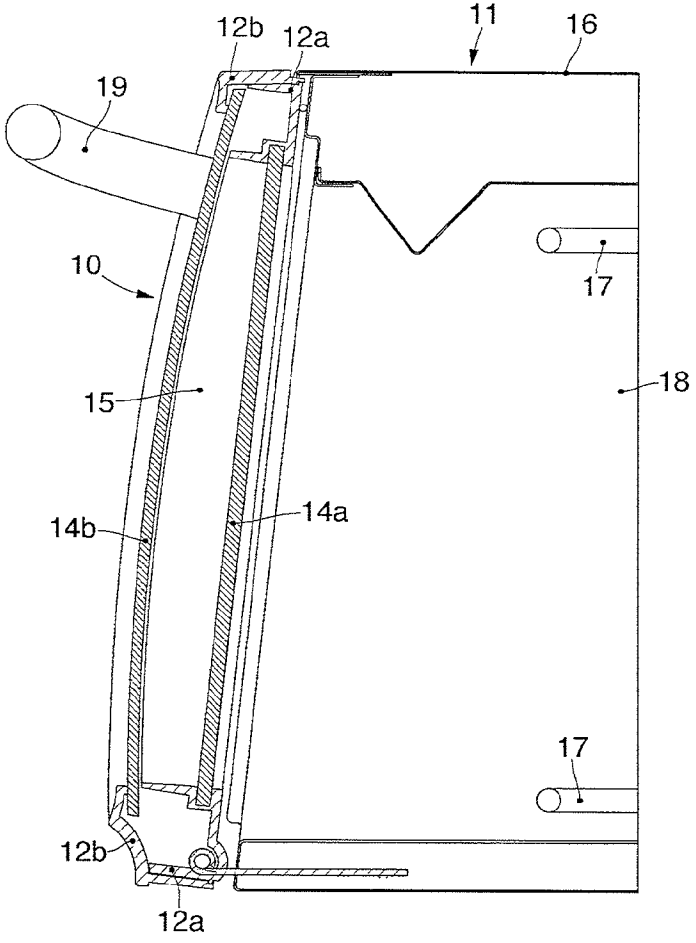
FIG. 2 is a lateral view in section of part of the apparatus in FIG. 1.

In the case of FIG. 2, the internal panel 14*a* is co-molded with the internal perimeter frame 12*a*, so as to define a compact structure and to obtain a perfect cohesion and seal between the two.

Thanks to the perimeter seal obtained between the internal panel 14*a* and corresponding internal perimeter frame 12*a*, the penetration of steam from inside the apparatus 11 into the closed chamber 15 is prevented, thus preventing the formation of condensation on the surfaces of the panels 14*a* and 14*b*.

In particular, after positioning the internal panel 14*a* in a mold, the material or mixture of materials that make up the internal perimeter frame 12*a* are introduced into the mold, for example by injection.

The mold is subsequently hot pressed so as to guarantee adhesion between the internal perimeter frame 12*a* and the internal panel 14*a* and, subsequently, to solidify upon it.

Finally, the second panel 14*b* can be attached, for example by jointing, to the external perimeter frame 12*b*, in turn attached to the internal perimeter frame 12*a*, defining the chamber 15 (FIG. 2).

In this way, the chamber 15 is sealed and hermetic in its internal side, thus considerably reducing the possibility of formation of condensation when the apparatus 11 to which the door 10 is associated is in use.

The seal of the chamber 15 on the internal side also allows to reduce the heat dispersion that occurs when the apparatus 11 is in use, thus allowing to obtain energy saving for cooking and/or heating food.

Furthermore, this production mode can easily be performed in series, considerably reducing the costs associated with the production of the door 10.

This production mode is also particularly versatile because, depending on specific requirements, it is possible to make doors 10 in different types of materials.

In particular, it is possible to choose both the composition of the perimeter frames 12, 12*a* and 12*b*, and also that of the panels 14*a* and 14*b*, without changing or making modifications to the production process described above.

In other forms of embodiment described here, the external perimeter frame 12*b* and the external panel 14*b* can also be made by co-molding, as described above.

In still other forms of embodiment described with reference to FIG. 3, the whole door 10 can be made by co-molding both panels 14*a* and 14*b* and the perimeter frame 12.

In this case, both the panels 14*a* and 14*b* are positioned in the mold as cited above, and subsequently the material that makes up the perimeter frame 12 is injected.

Consequently, during the hot compression operation, the material of the perimeter frame 12 adheres to both the panels 14*a* and 14*b*, solidifying on them.

This solution guarantees that the chamber 15 has hermetic characteristics both on the internal side and on the external side, guaranteeing even more that the formation of condensation is prevented on the surfaces of the panels 14*a* and 14*b* facing toward the chamber 15.

In this way, moreover, the chamber 15 is obtained directly during the co-molding process, without needing to attach the different components of the door 10 to each other.

Furthermore, in this way it is also possible to reduce the formation of molds, fungi or other parasite organisms, since the chamber 15 has less tendency to get dirty inside, because it is sealed.

It is clear that modifications and/or additions of parts may be made to the door 10 for an apparatus 11 for cooking and/or heating food, and the corresponding production method as described heretofore, without departing from the field and scope of the present invention.

It is also clear that, although the present invention has been described with reference to some specific examples, a person of skill in the art shall certainly be able to achieve many other equivalent forms of door 10 for an apparatus 11 for cooking and/or heating food, and the corresponding production method, having the characteristics as set forth in the claims and hence all coming within the field of protection defined thereby.

The invention claimed is:

1. A door for an apparatus to cook and/or heat food, wherein the door comprises a perimeter frame and two panels, said two panels including an internal panel and an external panel, said two panels located distanced and facing each other and delimited externally by said perimeter frame, so as to form a closed chamber, at least said internal panel being co-molded with the perimeter frame to form a hermetic perimeter seal between the internal panel and the perimeter frame configured to prevent penetration of steam between the internal panel and the perimeter frame into the closed chamber, wherein said internal panel is made of a material that is more resistant to heat than a material of the external panel, and wherein the closed chamber is hermetically sealed on both an internal side and an external side.

2. Door as in claim 1, wherein the door comprises two perimeter frames each co-molded separately with one of the two panels.

3. Door as in claim 1, wherein the door comprises a perimeter frame co-molded with both panels.

4. Door as in claim 1, wherein each panel is made of a transparent material chosen from a group comprising glass, plastic material such as polycarbonate, Plexiglas or polymethylmethacrylate or other suitable material.

5. Method to produce a door, wherein the door includes at least a perimeter frame and two panels, said two panels including an internal panel and an external panel, and wherein the method comprises positioning said panels opposite and distanced from each other, delimiting them externally with the at least one perimeter frame, in order to form a closed chamber, at least said internal panel being obtained by co-molding with the at least one perimeter frame to form a hermetic perimeter seal between the internal panel and the perimeter frame configured to prevent penetration of steam between the internal panel and the perimeter frame into the closed chamber, the method further comprising forming the internal panel of a material that is more resistant to heat than a material of the external panel, and wherein the step of forming the closed chamber comprises hermetically sealing the closed chamber on both an internal side and an external side.

6. Method to produce the door as in claim 5, wherein the method co-molds separately at least one panel with the respective perimeter frame.

7. Method to produce the door as in claim 5, wherein the method co-molds both the panels with the perimeter frame.

8. Apparatus to cook and/or heat food comprising a door as in claim 1.

9. Apparatus as in claim 8, said apparatus co-operatively defining an internal cooking zone with the door, the apparatus further comprising one or more heating elements located in the internal cooking zone, where the internal panel is closer to the one or more heating elements than the external panel.

10. Apparatus as in claim 9, wherein a wall of the internal cooking zone extends between the one or more heating elements and part of the internal panel.

11. Door as in claim 1, further comprising a gripping handle extending from the external panel.

12. Door as in claim 1, wherein the perimeter frame is made of metal.

13. Door as in claim 1, wherein the perimeter frame comprises a plastic material selected from the group consisting of polybutylene terephthalate (PBT), polypropylene (PP), polyethylene (PE), polyethylene terephthalate (PET), polymethylmethacrylate (PMMA), polystyrene (PS), or a combination thereof.

14. Door as in claim 3, wherein the perimeter frame is co-moulded with both sides to hermetically seal the closed chamber.

* * * * *